US006563036B1

(12) United States Patent
Biasini

(10) Patent No.: US 6,563,036 B1
(45) Date of Patent: May 13, 2003

(54) EDGE MOUNTED TRAP BAG

(76) Inventor: Americole R. Biasini, 2101 Ontario St., Bellingham, WA (US) 98226

( * ) Notice: Subject to any disclaimer, the term of this patent is extended or adjusted under 35 U.S.C. 154(b) by 0 days.

(21) Appl. No.: 09/940,281

(22) Filed: Aug. 27, 2001

(51) Int. Cl.[7] ..... G10G 7/02
(52) U.S. Cl. ..... 84/453; 84/327
(58) Field of Search ..... 84/453, 327; 206/756, 206/757, 759, 760, 762, 764

(56) References Cited

U.S. PATENT DOCUMENTS 4,535,922 A 8/1985 Yarnold
4,632,241 A * 12/1986 Brough et al. ..... 206/764
4,715,499 A 12/1987 Franklin
4,750,402 A 6/1988 Markey
4,773,535 A 9/1988 Cook
4,901,899 A 2/1990 Barrett
5,012,963 A 5/1991 Rosenbaum
5,117,724 A 6/1992 Gardner
5,653,333 A * 8/1997 Webster ..... 206/45.2
6,145,639 A * 11/2000 Roper ..... 190/102

* cited by examiner

*Primary Examiner*—Kim Lockett
(74) *Attorney, Agent, or Firm*—Robert B. Hughes; Hughes Law Firm, PLLC

(57) ABSTRACT

The apparatus of the present invention 1) holds percussion mallets for transportation or storage, 2) converts any concert music stand or desk into a trap table for holding mallets and small percussion instruments such as tambourines, triangles, and claves thereon, and 3) provides a pocketed surface disposed below the surface of the music desk to hold mallets in an easily accessible manner. The upper portion of the trap bag has a sleeve which slips over the shelf or edge of the music desk, securing the trap bag to the desk. A padded portion rests on the surface of the desk to sustain small percussion instruments and mallets. The stick or mallet holding segment hangs below the desk to contain the mallets in a performance ready posture for the percussionist. When the performance is over, the trap bag is lifted off the edge of the desk and closed for easy transit or storage.

28 Claims, 12 Drawing Sheets

EDGE MOUNTED TRAP BAG

BACKGROUND OF THE INVENTION

1. Field of the Invention

The present invention relates to the field of carrying and storage devices. More particularly, the invention pertains to a carrying case which may be mounted as a padded surface to a music desk, reading stand or other working surface, thereby providing easy access to the items carried.

2. Description of the Prior Art

Until now, carrying cases have been draped over planar, horizontal surfaces, for providing access to the items carried within the case.

For example, U.S. Pat. No. 4,750,402 to Markey is for a Folding Table Cover For Handbells. The Table Cover comprises a padded cover portion and a detachable apron that extends downwardly from the periphery of the cover portion. The apron provides aesthetic effect, not contributing substantively to the structure of the Table Cover.

U.S. Pat. No. 4,773,535 issued to Cook discloses a Portable Tool Case. The tool case is composed of at least two panels attached together, each panel having a plurality of pockets thereon. In a first embodiment, the panels are attached to each other along an adjacent edge, thus forming a hinge, whereby the panels may be folded closed, the pocket carrying surface of each panel being disposed adjacent to one another when closed. The Tool Case disclosed in the first embodiment may also be unfolded, into an open position, for draping the case over a horizontal elongated member. In a second embodiment of the Portable Tool Case, the panels each include an upturned lip about each of the unhinged edges for forming an attache type of carrying case. In a third embodiment, the panels form four sides of a box shaped case, having a single open end for being received about a table surface.

U.S. Pat. No. 5,117,724 to Gardner discloses a Drumstick Carrier Apparatus and Method. The drumstick carrier is composed of a horizontal seat portion having a downwardly depending skirt extending from the periphery of the seat portion. A plurality of pockets are mounted on the outside of the skirt. The seat portion is intended to be placed on the seat of a drummer's stool. The Drumstick Carrier may be rolled up for storing and transporting the drumsticks.

A Trap Stand Carrier is disclosed in U.S. Pat. No. 4,535,922 to Yarnold. The Trap Stand Carrier has an elongated main brace with straps at either end thereof, or alternatively, a length of material attached along one edge thereof to the brace, for securing objects such as a music stand to the brace. A handle is provided on the brace that may be moved along the brace for balancing the load. Additionally, shoulder straps may be provided for mounting the carrier on a person's shoulder.

None of the aforementioned devices appear to work with, or make use of the shelf or upright ledge typically found on the support surface or face of a music desk or book stand. If it is even possible to mount these devices on a typical music desk or book stand, the shelf or upright ledge would prove troublesome, creating an uneven surface on the covered desk top. The devices discussed, generally drape over a substantially planar surface, none are mountable on an edge, whether perpendicular to or planar with the support surface.

Percussionists use a wide variety of percussion mallets to extract desired sounds from varied percussion instruments, such as drums, cymbals, and percussion keyboard instruments. Percussionists require a flat surface on which to place these mallets and small percussion instruments during performances for immediate retrieval and application. The common method is to use an expensive trap table made exclusively for this purpose. Because of the cost, most performing ensembles rarely employ more than one trap table. In addition, percussionists must purchase a stick bag to contain their mallets because the trap table is not suitable for transporting the mallets.

There is a demonstrated need in the field of music for a bag which can be used to carry and store items, such as percussion mallets, and which converts an ordinary music desk into a trap table, providing easy access to the same items and having a cushioned table top cover which is secured to an edge of the music desk or other supporting surface. Such a bag would prove useful in many other areas where items need to be stored and carried, and easy access provided once the destination has been reached, such as for books, papers and tools.

SUMMARY OF THE INVENTION

The present invention is a carrying case or trap bag which may be mounted to a planar edge or an upright edge of a music desk, book stand or other supporting surface, thereby providing a padded working surface, as well as easy access to the items carried in the trap bag. The trap bag provides an attache style internal compartment, having pockets defined therein, that may be opened or closed.

The trap bag is comprised of two halves, each half having an outer surface and an inner surface. A first hinge or fold is formed along the adjacent edges of the halves such that the inner surfaces of each of the halves forms one continuous surface, and likewise, the outer surfaces of each of the halves forms another continuous surface. The trap bag may be folded into a closed position in which the inner surfaces are opposed to each other, or unfolded into an open position. It may be further folded on a line perpendicular to the first fold line, then secured in the folded position for carrying. The inner surface of a lower half carries at least one pocket for receiving the items to be carried or stored.

For use as a trap table, the bag may be completely unfolded into an open position and mounted on a music desk. An envelope is formed at the periphery of the upper half on the edge opposite the hinge or fold. The envelope has a slot or opening therein for receiving an edge of the supporting surface. The slot or opening may be oriented for receiving either a planar edge of the supporting surface or an edge formed by an upright ledge formed on the supporting surface, such as on a music desk or book stand. A pair of side walls may be formed around the periphery of the first or second, or both halves, to define a protected internal compartment therein.

Additional pockets may be provided on any of the inner or outer surfaces of either half of the bag, as well as on or in the other pockets. Straps and handles may be provided to make the trap bag easier to hold, carry and transport. Conventional closures such as zippers, clasps, buckles, buttons, straps and loop and hook fastener may be provides about the periphery of the halves, or on any of the pockets.

A first object of the invention is to provide an easily transportable trap bag for items including but not limited to percussion mallets, books, papers, and tools, having an internal compartment including at least one pocket therein for carrying items and a cover for closing the compartment.

A second object of the invention is to provide an attache style trap bag having an internal compartment, and a cover for closing the internal compartment, and also including pockets in the compartment for holding various items placed in the trap bag.

A third object of the invention is to provide a trap bag that may be mounted, in an open position, onto the edge of a supporting surface, to provide a cushioned working surface, as well as, easy access to the items carried in the trap bag.

A fourth object of the invention is to provide a trap bag that may be used with a working surface that has an upright edge formed thereon.

A fifth object is to provide a device for holding percussion mallets in a storage mode, that quickly and easily converts any concert music stand into a trap table, for holding and providing ready access to devices such as mallets and small percussion instruments during a performance.

DESCRIPTION OF THE PREFERRED EMBODIMENTS

Figure 1:
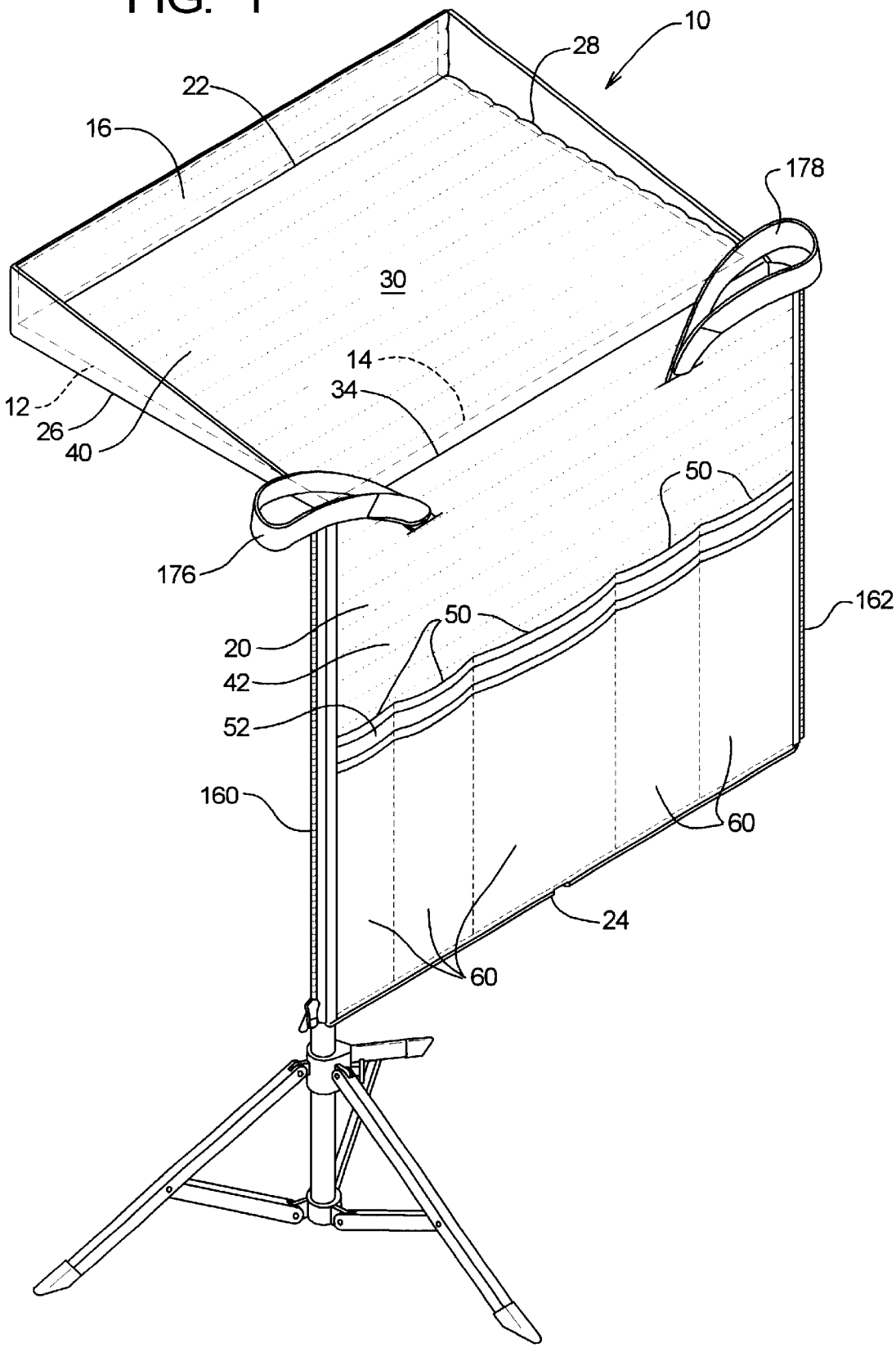
FIG. 1 is a perspective view of a trap bag mounted to a music desk as a trap table.

With reference to FIG. 1, the article, bag or trap bag 10 is mountable on a support surface of a support structure, desk or music desk 12. In its various configurations, the trap bag 10 may be mounted on a planar edge 14 of the desk 12 or on an upright edge or shelf 16 of the desk 12. Typical music desks 12 have a shelf 16 integrally formed at the lower edge of the support surface and extending perpendicularly therefrom. The music desk 12 and shelf 16 are indicated by the dashed lines in FIG. 1. While the preferred embodiments will be discussed in regard to a music desk 12, the trap bag 10 may be mounted on any support surface having an edge 14, and likewise may be used for carrying items other than musical instruments and mallets.

Figure 2:
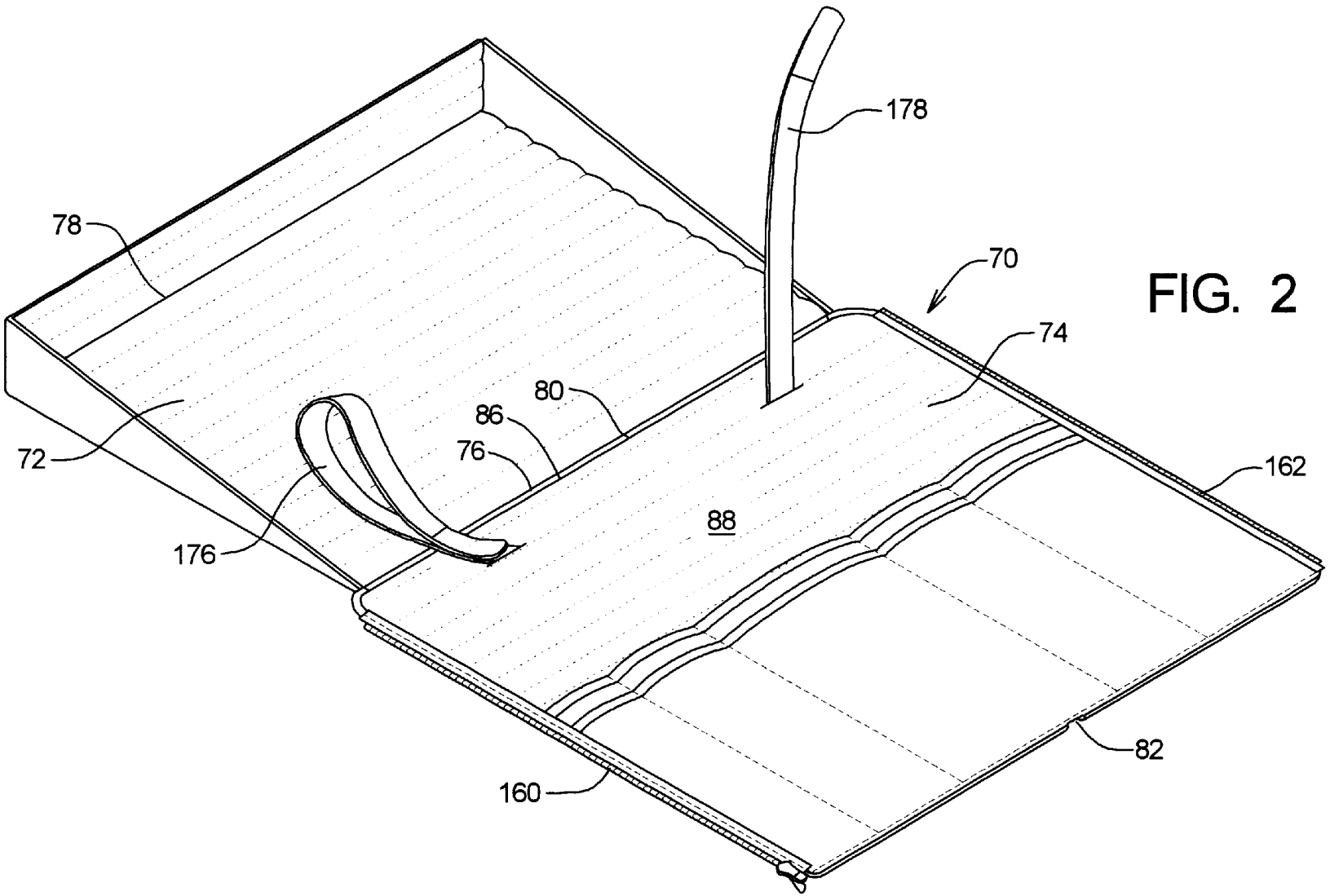
FIG. 2 is a perspective view of an alternative embodiment of a trap bag formed from two panels, the trap bag in the open position.

With general reference to all of the Figures except FIG. 2, the trap bag 10 is preferably formed from a panel 20 of sturdy, flexible material such as canvas. The panel 20 may be of a laminate construction. Preferably, the panel 20 is cushioned and quilted to provide a cushioned trap table surface for the percussionist. In the preferred embodiment, the panel 20 has an upper edge 22, a lower edge 24, a first side edge 26 and a second side edge 28 opposed to the first side edge 26. The panel 20 has an inner surface 30 and an outer surface 32. The panel 20 is dimensioned such that the length between the upper edge 22 and the lower edge 24 is approximately twice the length of the music desk 12, and the width between the side edges 26, 28 is substantially the width of the music desk 12. In the case of a typical music desk 12 this results in a panel 20 of 38½×22¼ inches.

Preferably, a first fold line 34 is formed parallel to, and between, the upper and lower edges 22, 24, respectively. The first fold line 34 divides the panel 20 into an upper half 40, between the upper edge 22 and the first fold line 34, and a lower half 42, between the lower edge 24 and the first fold line 34.

The trap bag 10 is closed by folding the upper half 40 and lower half 42 together such that the portions of the inner surface 30 divided by the first fold line 34 are adjacent. The trap bag 10 is opened by folding the upper and lower halves 40, 42 apart, thereby separating the portions of the inner surface 30 divided by the first fold line 34 from one another. It may be convenient to make the upper half 40 of the panel 20 narrower than the lower half 42 of the panel 20. This prevents the comers from crimping when the trap bag 10 is closed.

An additional, second or quarter fold line 44 may be provided perpendicular to the first fold line 34. This permits the bag 10 to be folded into a less bulky transport position, so it may be conveniently carried.

A first row of pockets 50 is formed on the inner surface 30 of the lower half 42 of the panel 20, between the lower edge 24 of the panel 20 and the first fold line 34. The first row of pockets 50 is formed from a first sheet of material 52 which is laid on the inner surface 30, having a first edge adjacent the lower edge 24 of the panel 20, and a second and third edge adjacent the respective side edges 26, 28 of the panel 20. The first sheet 52 is sewn about its first, second, and third edges to the respective edges of the lower half 42 of the panel 20. The pockets 50 are open toward the first fold line 34. Individual pockets may then be formed by sewing the first sheet to the panel 20 in rows perpendicular to the upper and lower edges 22, 24, respectively. The number of rows, and space between rows may be varied to suit the types of items expected to be carried in the bag 10. A second row of pockets 60, may be formed on top of the first row of pockets 50, in the same manner as the first row 50. The pockets of the second row 60 should not be as deep as the pockets of the first row 50, to allow easy access to them items stored in all of the pockets 50, 60. Other rows or pockets may be added, however, too many rows will be found to be ungainly.

Alternatively, as shown in FIG. 2, the trap bag 70 may be formed of an upper panel 72 and a lower panel 74. The upper panel 72 has a hinge edge 76 and an open edge 78 opposed to the hinge edge 76. The lower panel 74 has a hinge edge 80 and an open edge 82 opposed to the hinge edge 80. The hinge edges 76, 80 are pivotally joined by a flexible hinged connection 86. The upper panel 72 and lower panel 74 may be pivoted relative to one another between a closed position where the open edges 78, 82 are brought together, and an open position in which the open edges 78, 82 are relatively spaced apart. The surfaces of the upper panel 72 and lower panel 74 which are adjacent one another in the closed position define the inner surface 88 thereof. The opposed surface defines the outer surface 90 of the panels 72, 74. The remainder of the trap bag 70 may be constructed and used in the same fashion as the single panel trap bag 10.

There are a variety of structures which may be used to mount the trap bag 10 to the planar edge 14 or upright shelf 16 of a support surface or music desk 12. A number of these variations will now be discussed.

Figure 3A:
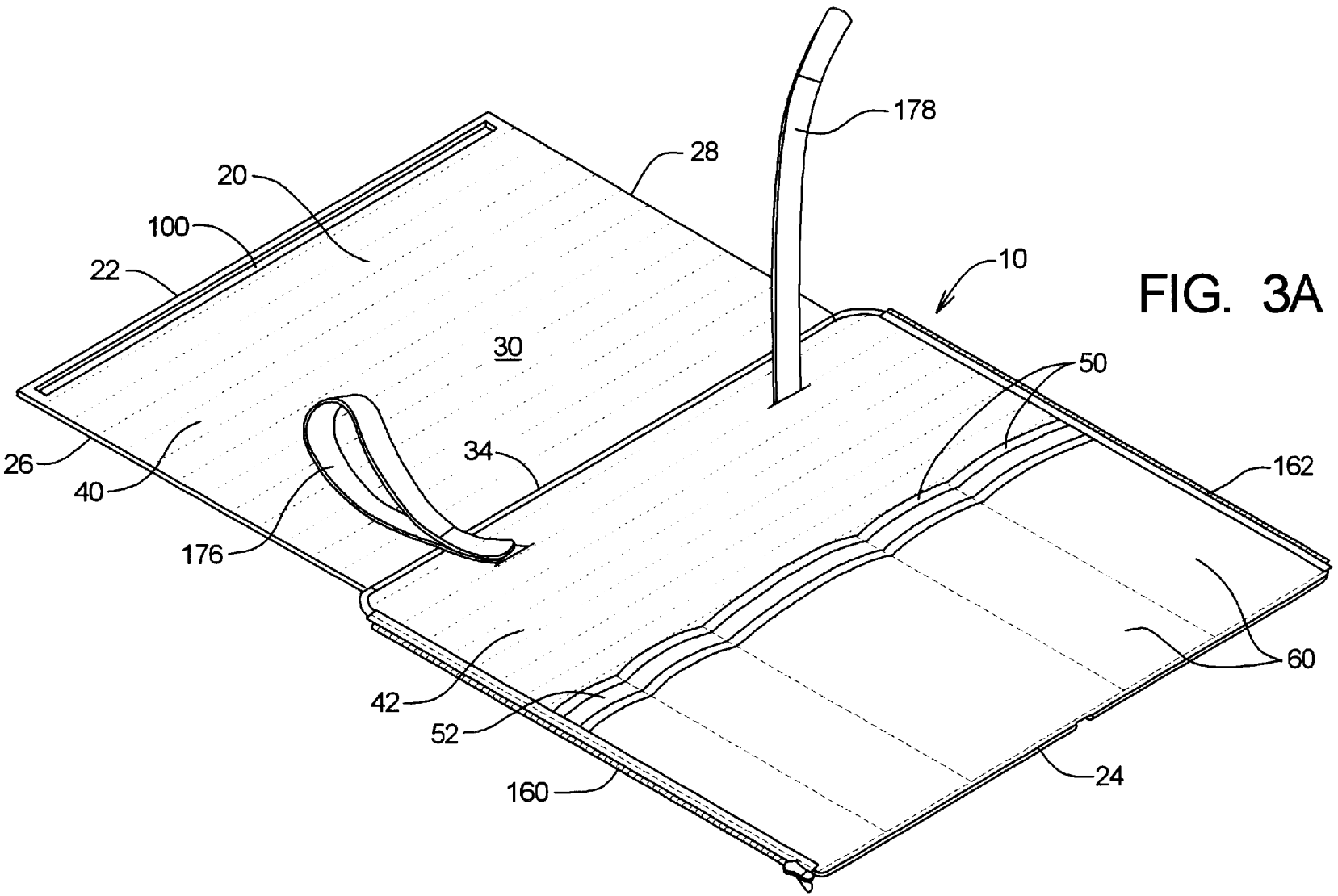
FIG. 3A is a perspective view of a first preferred embodiment of the trap bag having a mounting slot form therein, in the open position.
Figure 3B:
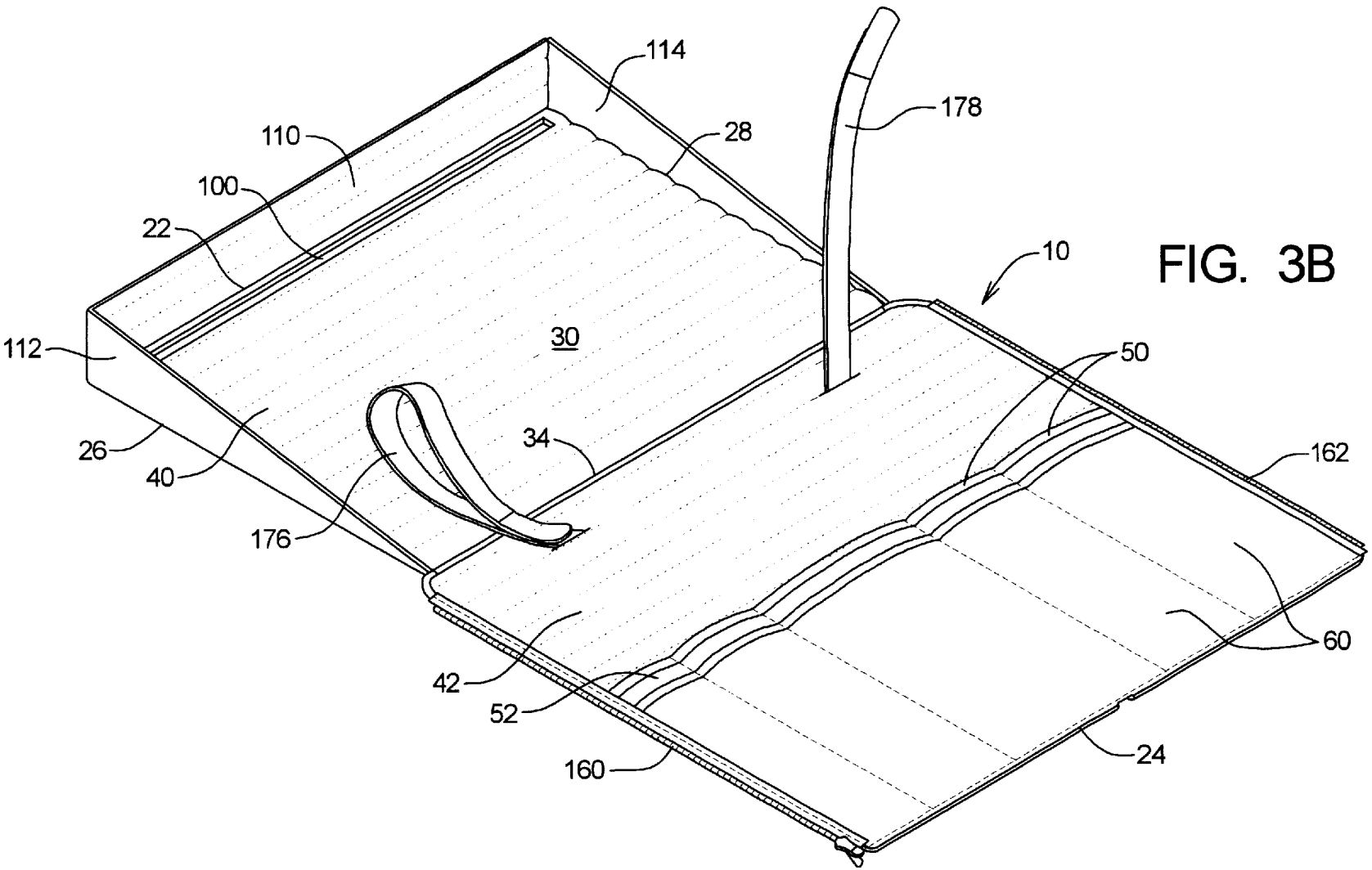
FIG. 3B is a perspective view of the first preferred embodiment of the trap bag including a peripheral wall and side walls about the upper half thereof.
Figure 3C:
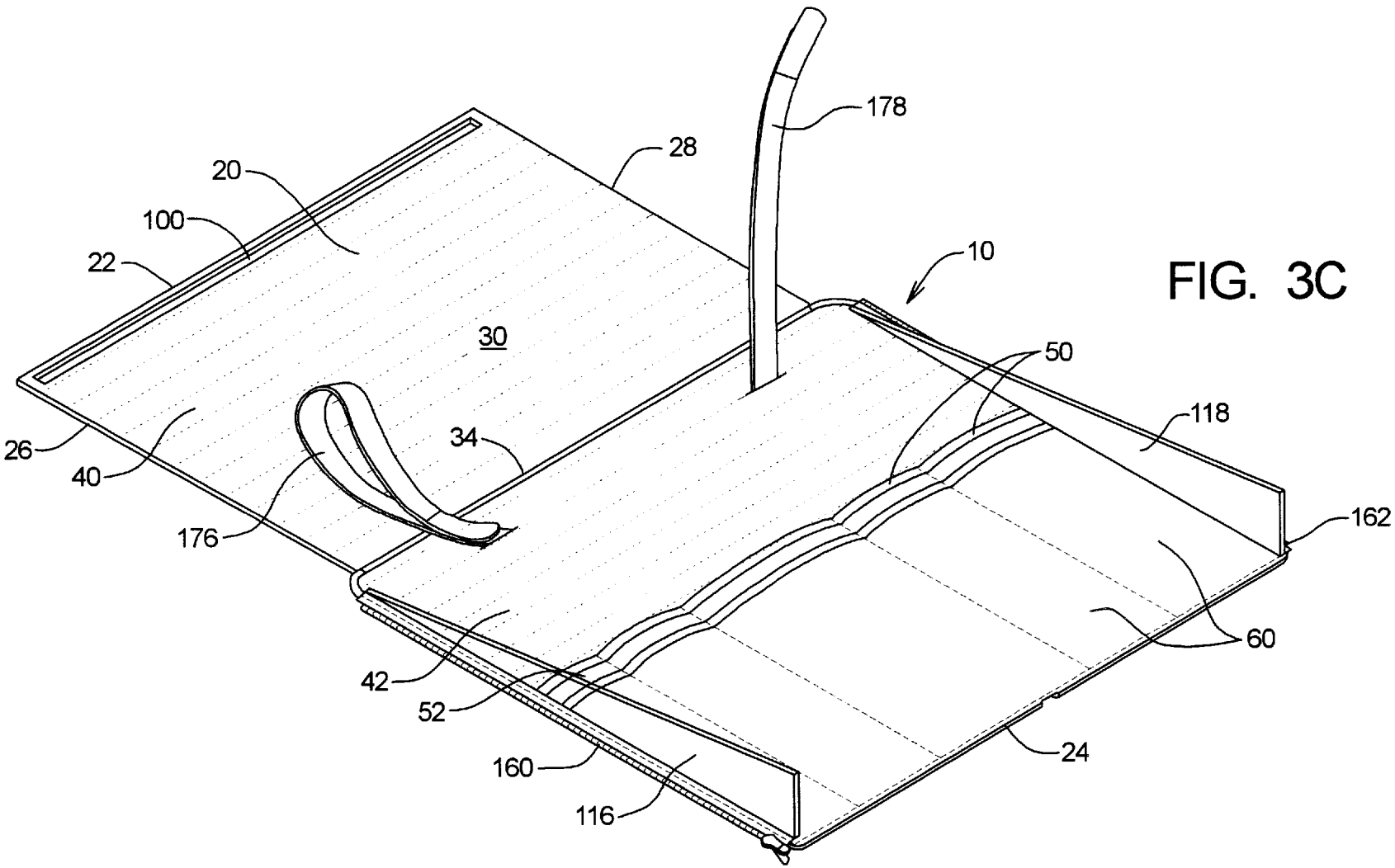
FIG. 3C is a perspective view of the first preferred embodiment of the trap bag including side walls about the lower half thereof.

With reference to FIGS. 3A, 3B, and 3C, a first preferred embodiment of the mounting structure comprises an elongated aperture 100 formed in the panel 20, parallel to and proximate the upper edge 22 thereof. The aperture 100 is dimensioned to receive the upright shelf 16 of a music desk 12 therethrough for mounting the trap bag 10 to the desk 12.

With specific reference to FIG. 3B, a peripheral wall 110 may be provided along the upper edge 22 of the panel 20, adjacent the aperture 100. The peripheral wall 110 is preferably formed at a right angle to, and extending vertically from the inner surface 30 of the panel 20. When the trap bag 10 is mounted to the desk 12, the wall 110 provides a barrier which prevents percussion mallets and the like from falling off the support surface of the desk 12.

With continuing reference to FIG. 3B, a pair of side walls 112, 114, 116, 118 may also be provided, the side walls 112, 114, 116, 118 formed along the side edges 26, 28 of the panel 20. The side walls 112, 114 may be formed on the upper half 40, extending between the first fold line 34 and the upper edge 22. In this case, the side walls 112, 114 may each be joined to the peripheral wall to form an enclosure. Alternatively, as shown in FIG. 3C, side walls 116, 118 may be formed on the lower half 42 of the panel 20, extending between the first fold line 34 and the lower edge 24, the enclosure being fully defined only when the bag is closed. In either case, the side walls 112, 114, 116, 118 preferably taper toward the first fold line 34. This provides a trap bag 10 which when closed resembles an attache style trap bag 10.

With reference to FIGS. 4A, 4B, 4C, and 4D, a second preferred embodiment of the mounting structure comprises the elongated aperture 100 of the first preferred embodiment, along with a sleeve 120 formed on the inner surface 30, which runs parallel to and proximate the upper edge 22 of the panel 20. The sleeve 120 is preferably formed by an extension of the material forming the upper half 40 of the panel 20 which has been folded over itself in the direction of the first fold line 34. The sleeve 120 is preferably formed at a right angle to, and extending up, out of the inner surface 30 of the panel 20. A lateral mounting slot 122 at the edge of the sleeve 120 is aligned with the aperture 100, such that the shelf 16 of a music desk 12 may be received through the aperture 100 and into the mounting slot 122 of the sleeve 120 thus securing the trap bag 10 to the desk 12.

Figure 4A:
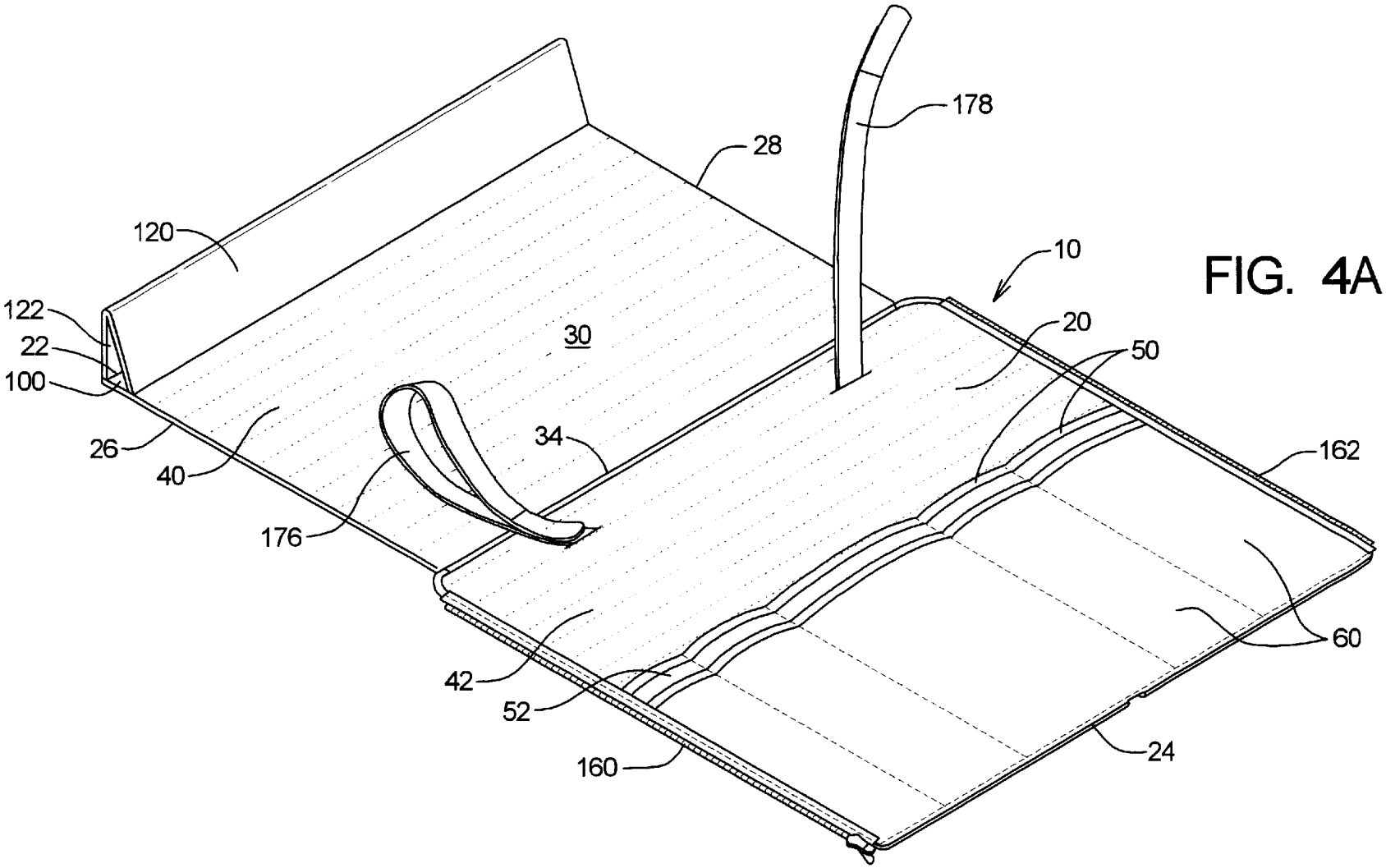
FIG. 4A is a perspective view of a second preferred embodiment of the trap bag, having a mounting slot therein and a sleeve in register with the mounting slot, the trap bag in the open position.
Figure 4B:
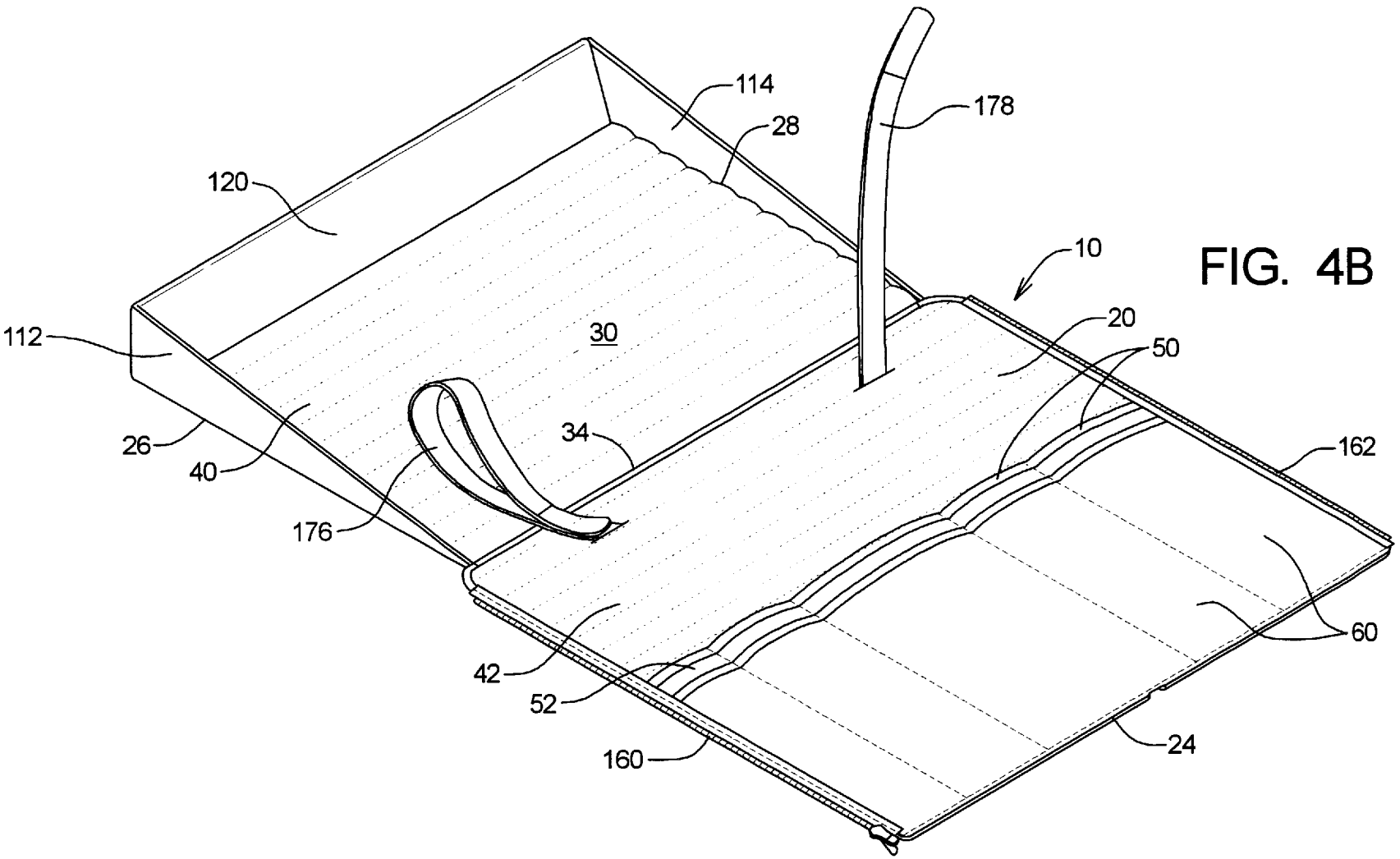
FIG. 4B is a perspective view of the second preferred embodiment of the trap bag, including side walls about the upper half thereof.
Figure 4C:
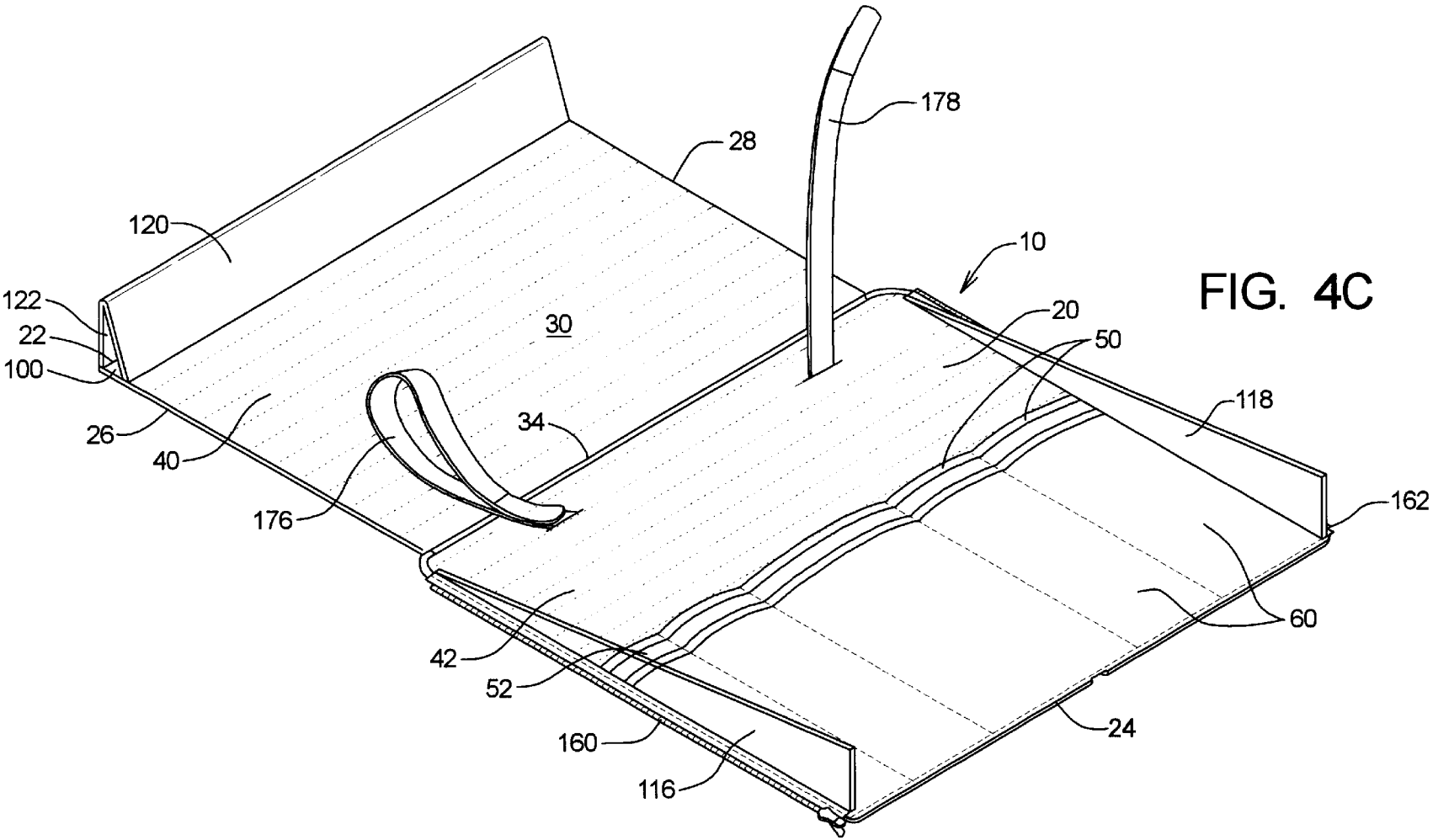
FIG. 4C is a perspective view of the second preferred embodiment of the trap bag, including side walls about the lower half thereof.
Figure 4D:
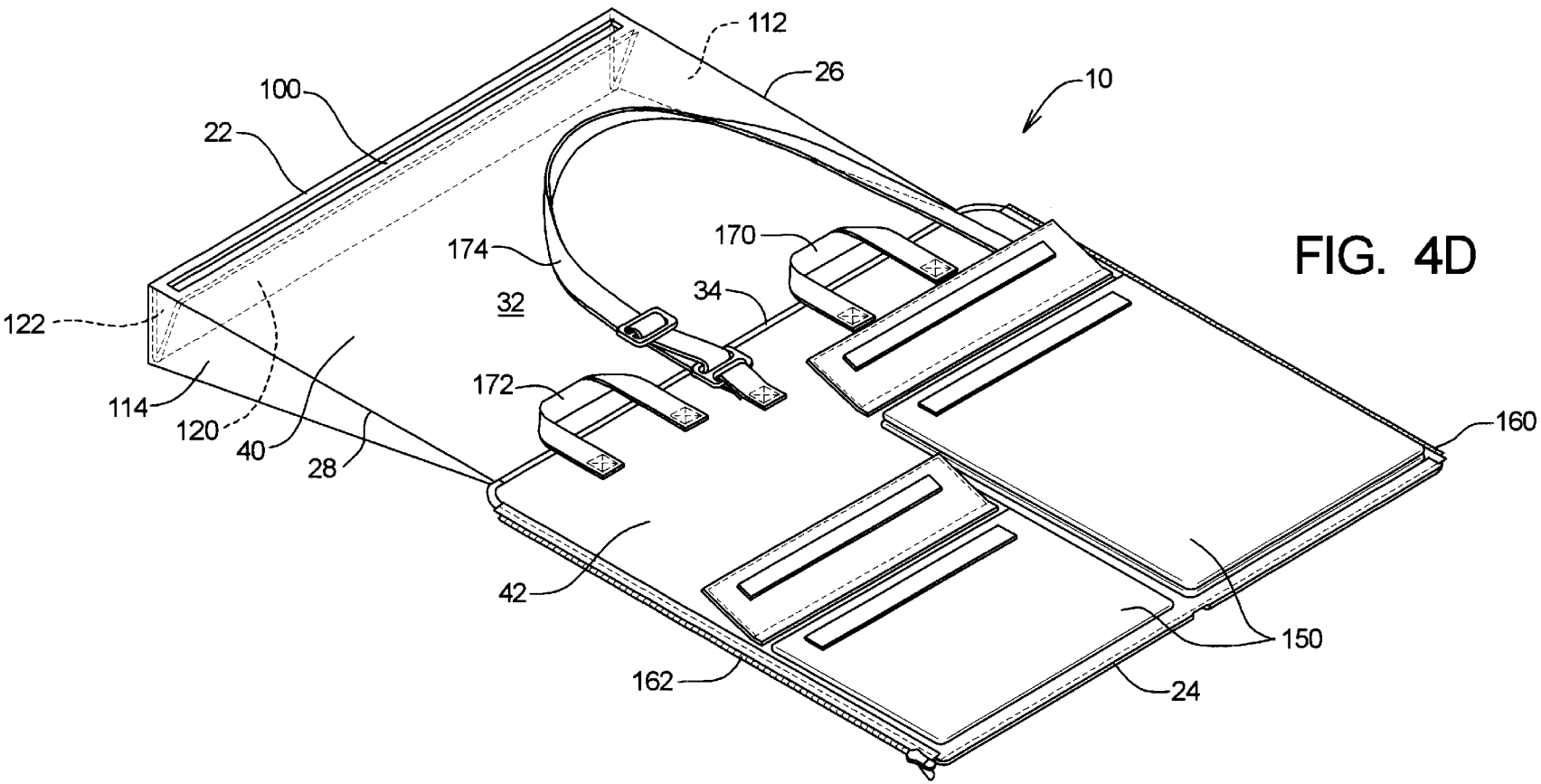
FIG. 4D is a perspective view of the second preferred embodiment of the trap bag wherein the sleeve has two openings therein.

The sleeve 120 serves as a peripheral wall along the upper edge 22 of the panel 20. As in the variations of the first preferred embodiment, a pair of side walls 112, 114, 116, 118 may also be provided, the side walls 112, 114, 116, 118 formed along the respective side edges 26, 28 of the panel 20. As shown in FIG. 4B and 4D, the side walls 112, 114 may be formed on the upper half 40 of the panel 20, extending between the first fold line 34 and the upper edge 22. In this case, the side walls 112, 114 may each be joined to the sleeve 120 to form an enclosure. Alternatively, as shown in FIG. 4C, the side walls 116, 118 may be formed on the lower half 42 of the panel 20, extending between the first fold line 34 and the lower edge 24, the enclosure being fully defined only when the bag is closed. In either case, the side walls 112, 114, 116, 118 preferably taper toward the first fold line 34.

Figure 5:
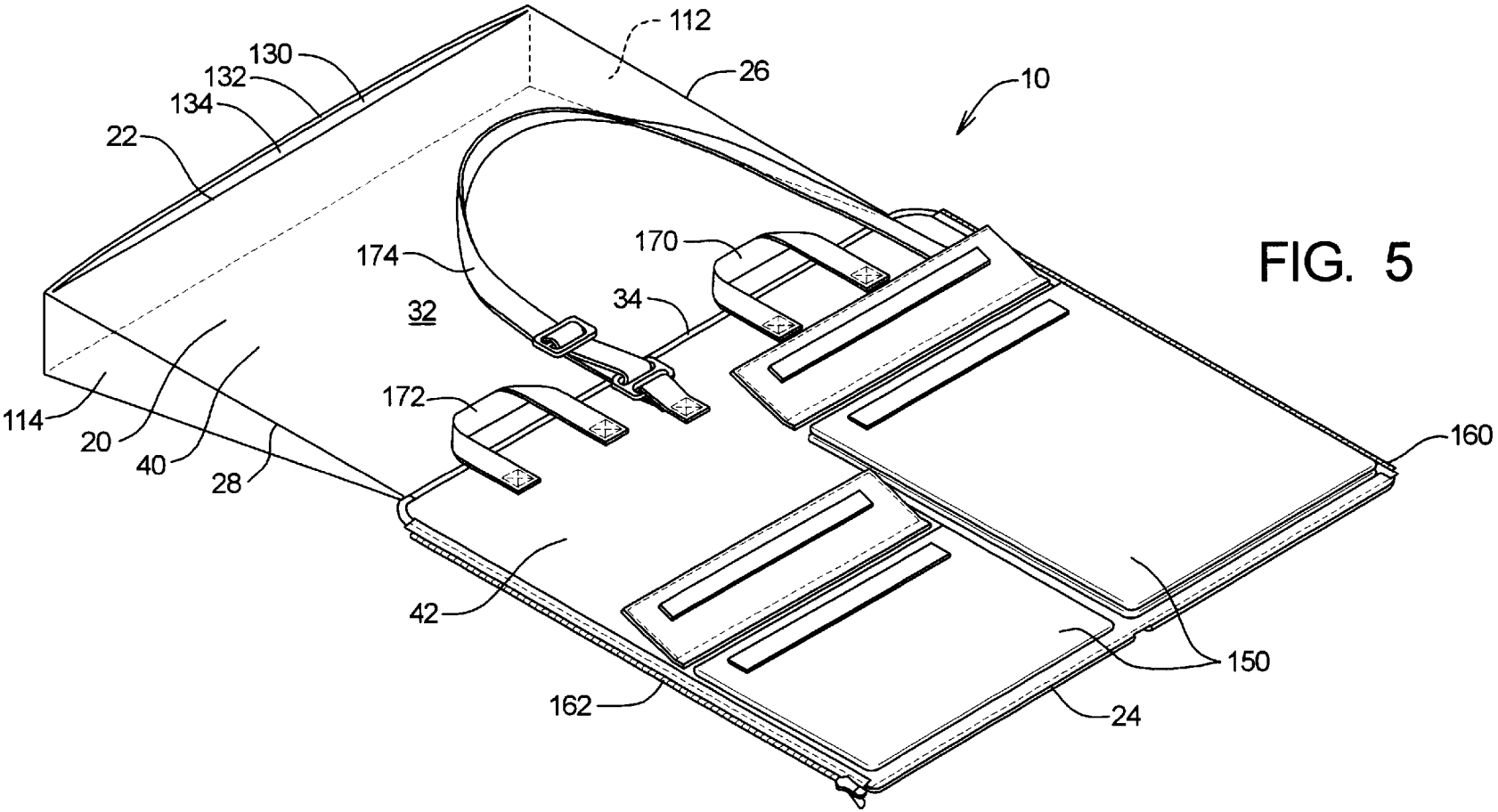
FIG. 5 is a perspective view of a third preferred embodiment of the trap bag having a mounting sleeve adjacent the upper edge thereof.

With reference to FIG. 5, a third preferred embodiment of the mounting structure comprises an envelope 130 formed adjacent to the panel 20 along its upper edge 22. Preferably, the envelope 130 is formed at a right angle, extending vertically from the inner surface 30 of the panel 20, to which the envelope 130 is joined. Alternatively, the envelope 130 may be flexibly attached to the upper edge 22 allowing the envelope 130 to assume whatever position its use suggests. The open edge 132 of the envelope 130 is disposed along the upper edge 22 of the panel 20, and provides a lateral opening 134 in which the shelf 16 or upright ledge is mountingly received. The bottom edge 136 of the envelope 130 may be closed, or may be open to allow shelves 16 of various sizes to be mounted (not shown). As with the other embodiments, side walls 112, 114, 116, 118 may be added to the panel 20.

Figure 6:
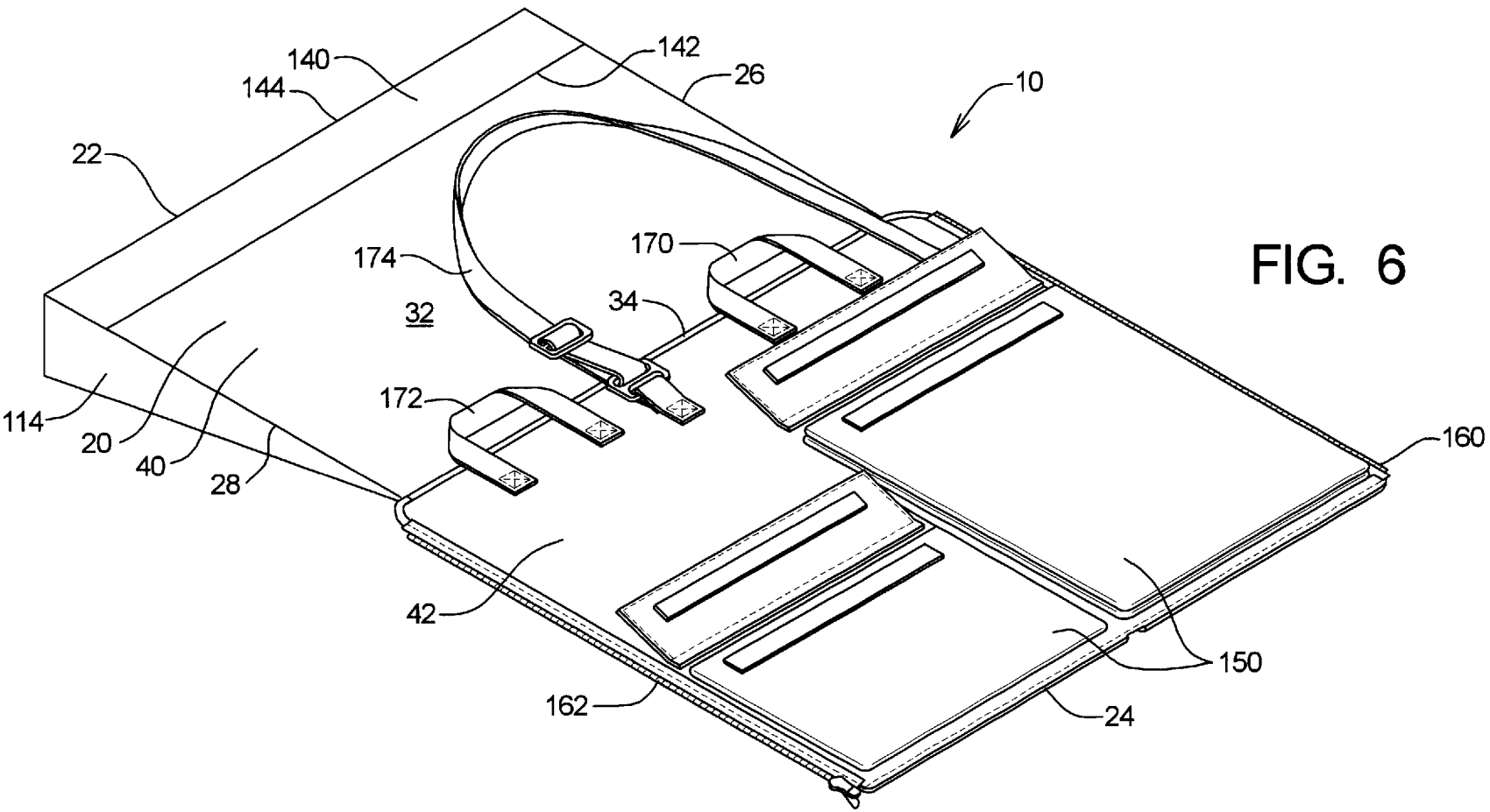
FIG. 6 is a perspective view of a fourth preferred embodiment of the trap bag having a planar mounting sleeve.

With reference to FIG. 6, a fourth preferred embodiment of the mounting structure, particularly for mounting on a planar edge 14, comprises an engaging pocket 140 formed on, and parallel to, the outer surface 32 of the upper half 40 of the panel 20. The engaging pocket 140 has an open end 142 and a bottom end 144. The open end 142 is parallel to the upper edge 22 of the panel 20, and spaced between the upper edge 22 and the first fold line 34. The engaging pocket 140 is fixed along its side edges to the respective side edges 26, 28 of the panel 20. As above, the bottom end 144 of the engaging pocket 140 may closed, attached to the upper edge 22 of the panel 20, or it may be left open for mounting the tarp bag 10 at different lengths along the desk 12.

As best seen in FIGS. 4D, 5, 6, 7A and 7B, additional pockets 150 may be formed on the inner surface 30 and the outer surface 32 of the panel 20. These pockets 150 will all preferably open toward the first fold line 34. The first and second row of pockets 50, 60, as well as any additional pockets 150, may be left open or provided with conventional closures such as: snaps, buttons, zippers, buckles, hook and loop fastener material, and ties.

With general reference to all of the Figures, means for securing the bag in a closed position may be provided. Such means may include any conventional closures such as: snaps, buttons, zippers, buckles, hook and loop fastener material, and ties. Preferably, the securing means comprises a zipper. A first zipper section 160 is affixed along one of the side edges 26, 28 of the lower half 42 of the panel 20 and a second zipper section 162 for mating with the first zipper section 160 is affixed along the other side edge 26, 28 of the lower half 42 of the panel 20. Alternatively, the zipper or other closure may, in a similar manner, be provided on the peripheral wall 110 and side walls 112, 114, 116, 118 of the panel 20.

Figure 7A:
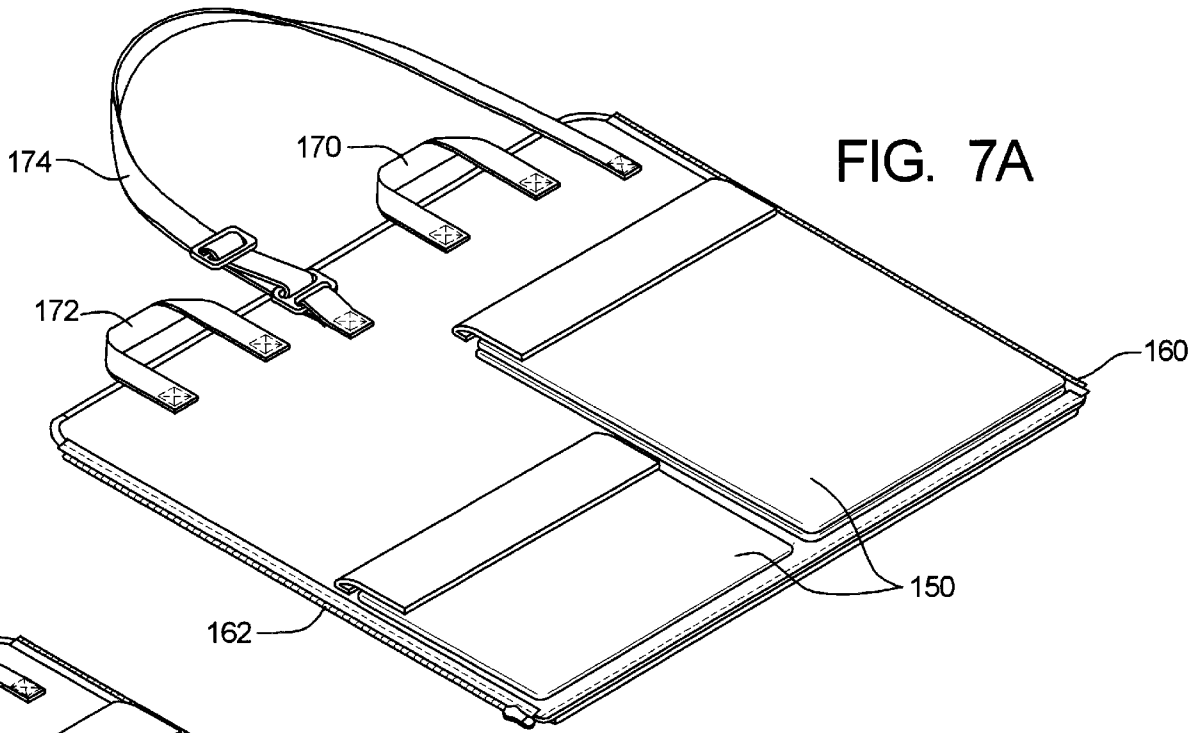
FIG. 7A is a perspective view of the trap bag folded in half into the closed position.
Figure 7B:
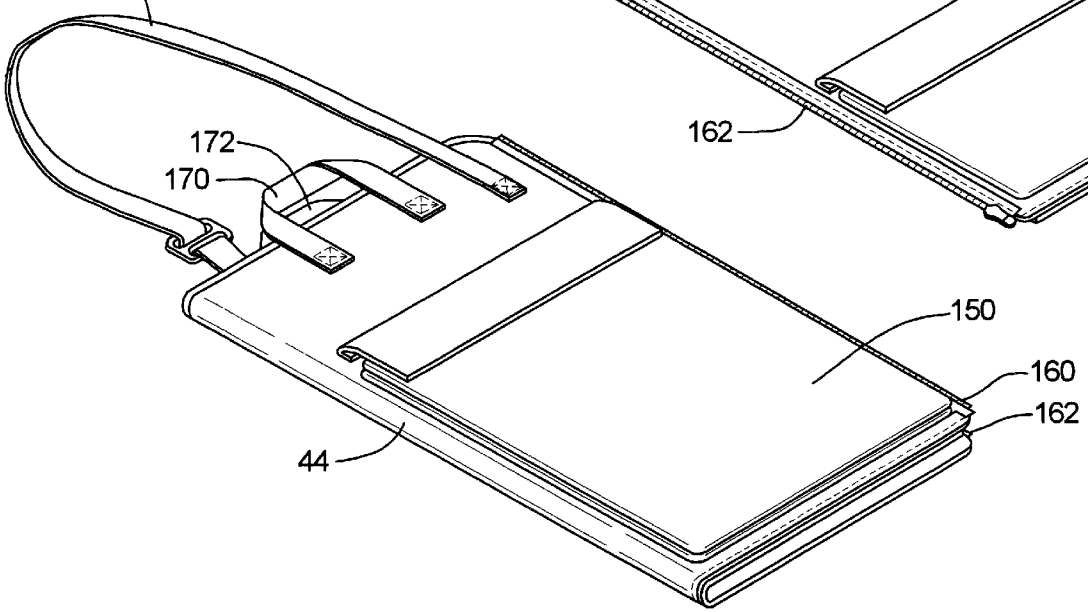
FIG. 7B is a perspective view of the trap bag folded in quarters into the preferred carrying position.

To convert the trap bag 10 from use as a trap table to use as a storage and transportation bag, the trap bag 10 is disengaged from the desk 10 on which it is being used. The trap bag 10 is then folded, as shown in FIGS. 7A and 7B, along the first fold line 34 so that the portions of the inner surface 30 on either side of the first fold line 34 are in contact with each other. Next the bag 10 is folded again, this time along a second fold line 44. The trap bag 10, now folded in quarters, has only its outer surface 32 exposed. The first zipper section 160 and the second zipper section 162 can be operatively joined, closing the trap bag 10 for easy carrying.

With reference to FIGS. 4D, 5, 7A and 7B, the trap bag 10 may be provided with handles 170, 172 as well as a carrying strap 174. The handles 170, 172 and strap 174 are preferably mounted to the outer surface 32, proximate the first fold line 34 or hinge member. The handles 170, 172 and strap 174 may be formed of nylon webbing. The handles 170, 172 may be provide with a half twist to make them easier to grasp. The strap 174 may be provided with conventional adjustment means.

With particular reference to FIGS. 1 and 2, a pair of handles 176, 178 may additionally be provided on the inner surface 30 of the panel 20, proximate the first fold line 34 or hinge member 86, as shown in FIGS. 1 and 2. Preferably, each of these handles 176, 178 is formed from a piece of webbing. The webbing has a first surface in contact with the inner surface 30 of the panel 20. The second surface of the webbing has hook fastener material covering one half of it, and loop fastener material covering the other half of the second surface. This permits a handle 176, 178 to be formed by placing one half of the second surface of the handle 176, 178 in engaging contact with the other half of the second surface, thus engaging the hook and loop fastener material.

Trim may be sewn on the various edges to protect the material from fraying and for decorative purposes.

In use, the trap bag 10 may be opened, and items such as mallets (not shown) are arranged by the user in the pockets 50, 60 based on the size of the item. The trap bag 10 is then closed, secured, and placed in storage, or transported to the desired location. In this way the items are protected within the cushioned trap bag 10. At the desired location, such as a concert hall, the securing means 160, 162 are released, and the trap bag 10 mounted onto the music desk 12 or other supporting apparatus. The aperture 100, envelope, or sleeve is placed over the planar edge 14 or shelf 16 of the desk 12 or other supporting surface. In the case of a music desk 12 mounted on a music stand, as shown in FIG. 1, the desk 12 is pivoted so it lies in a substantially horizontal plane. The planar edge 14 or shelf 16 of the desk 12 is received within the mounting structure 100, 120, 130, 140, the outer surface 32 of the upper half 40 of the panel 20 lays flat, adjacent the surface of the desk 12. The lower half 42 of the trap bag 10 is suspended from the desk 12 with the inner surface 30 and pockets 50, 60 exposed, so that the items in the pockets 50, 60 may be easily accessed. Small instruments, mallets and the like may be arrayed on the inner surface 30 for quick access by the user.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principals of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims which follow.

I claim:

1. A trap bag mountable on music desk having a shelf, the trap bag comprising:

a panel having an inner surface, an outer surface, an upper edge, a lower edge opposed to the upper edge, a first side edge and a second side edge opposed to the first side edge, a first fold line spaced between and parallel to the upper and lower edges;

at least one pocket formed on the inner surface of the panel between the first fold line and the lower edge, the pocket open toward the first fold line; and an envelope extending along and adjacent to the upper edge of the panel, the envelope having a lateral opening therein for engagingly receiving the shelf of the music desk.

2. The trap bag of claim 1 wherein the envelope defines a peripheral wall along the upper edge of the panel, extending substantially perpendicularly from the plane defined by the portion of the inner surface between the first fold line and the upper edge thereof.

3. The trap bag of claim 2 further comprising:

a first side wall extending perpendicularly from the inner surface between the upper edge and the first fold line, the first side wall adjacent to and along the first side edge of the panel; and a second side wall extending perpendicularly from the inner surface between the upper edge and the first fold line, the second side wall adjacent to and along the second side edge of the panel.

4. The trap bag of claim 3 further comprising:

a first zipper section extending along the first side edge from the first fold line, to the lower edge; and a second zipper section for mating with the first zipper section, the second zipper section extending along the second side edge from the first fold line to the lower edge.

5. The trap bag of claim 2 further comprising:

a first side wall extending perpendicularly from the inner surface between the lower edge and the first fold line, the first side wall adjacent to and along the first side edge of the panel; and a second side wall extending perpendicularly from the inner surface between the lower edge and the first fold line.

6. The trap bag of claim 2 further comprising:

a second fold line spaced between and parallel to the first and the second side edges.

7. The trap bag of claim 2 wherein the panel is quilted.

8. The trap bag of claim 2 further comprising:

a second layer of pockets.

9. An attaché style bag mountable on the edge of a support surface, the bag comprising:

an upper panel having a hinge edge and a open edge opposed to the hinge edge; a lower panel having a hinge edge and an open edge opposed to the hinge edge; a flexible intermediate hinge member hingedly connecting the hinge edge of the upper panel and the hinge edge of the lower panel such that the upper panel may be pivoted between a closed position where the open edges are proximate one another and an open position where the open edges are spaced relatively apart from one another;

at least one pocket affixed to the lower panel, the pocket having an opening therein, the pocket being open toward the hinge member; and a sleeve on the upper panel, proximate and parallel to the open edge thereof, the sleeve defining a mounting slot therein.

10. The bag of claim 9 wherein the mounting slot of the sleeve is substantially perpendicular to a plane defined by the upper panel.

11. An article mountable on a support structure having a support surface and an upright edge substantially perpendicular to the support surface, the article comprising:

a panel having an inner surface, an outer surface, an upper edge, a lower edge opposed to the upper edge, and a pair of opposed side edges, a first fold line spaced between and parallel to the upper and lower edges, the panel having an elongated aperture defined therethrough parallel to and proximate the upper edge thereof for mountingly receiving the support edge of the support structure; and at least one pocket attached to the inner surface of the panel between the first fold line and the lower edge, the pocket having an opening toward the first fold line.

12. The trap bag of claim 11 further comprising:

a peripheral wall along the upper edge extending perpendicularly from the inner surface of the panel.

13. The trap bag of claim 12 further comprising:

a first side wall extending perpendicularly from the inner surface between the upper edge and the first fold line, the first side wall adjacent to and along the first side edge of the panel; and a second side wall extending up from the inner surface between the upper edge and the first fold line, the second side wall adjacent to and along the second side edge of the panel.

14. The trap bag of claim 13 wherein the first side wall tapers from the peripheral wall to the first fold line; and the second side wall tapers from the peripheral wall to the first fold line.

15. The trap bag of claim 12 further comprising:

a first side wall extending perpendicularly from the inner surface between the lower edge and the first fold line, the first side wall adjacent to and along the first side edge of the panel; and a second side wall extending perpendicularly from the lower surface between the lower edge and the first fold line, the second side wall adjacent to and along the second side edge of the panel.

16. The trap bag of claim 14 further comprising:

a first zipper section extending along the first side edge from the first fold line to the lower edge; and a second zipper section for mating with the first zipper section, the second section extending along the first side edge from the first fold line to the upper edge.

17. The bag of claim 11 further comprising:

an envelope adjacent and parallel to the upper edge of the panel, the envelope having a lateral opening therein in register with the elongated aperture for engagingly receiving the support edge of the support structure.

18. The trap bag of claim 17 wherein the envelope extends perpendicularly from the inner surface of the panel.

19. The trap bag of claim 18 wherein the envelope defines a peripheral wall about the upper edge.

20. The trap bag of claim 19 further comprising:

a first side wall extending perpendicularly from the inner surface between the upper edge and the first fold line, the first side wall adjacent to and along the first side edge of the panel; and a second side wall extending perpendicularly from the inner surface between the upper edge and the first fold line, the second side wall adjacent to and along the second side edge of the panel.

21. The trap bag of claim 19 further comprising:

a first side wall extending perpendicularly from the inner surface between the lower edge and the first fold line, the first side wall adjacent to and along the first side edge of the panel; and a second side wall extending perpendicularly from the inner surface between the lower edge and the first fold line, the second side wall adjacent to and along the second side edge of the panel.

22. The trap bag of claim 20 wherein the panel is quilted.

23. The trap bag of claim 20 further comprising:

a second layer of pockets.

24. The trap bag of claim 20 further comprising:

a first zipper section affixed along the first side edge from the first fold line to the lower edge; and a second zipper section for mating with the first zipper section, the second section affixed along the first side edge from the first fold line to the upper edge.

25. A trap bag mountable on a supporting structure having a support surface having an edge, the trap bag comprising:

a panel having an inner surface, an outer surface, an upper edge, a lower edge opposed to the upper edge, a first side edge and a second side edge opposed to the first side edge, a first fold line spaced between and parallel to the upper and lower edges;

at least one pocket formed on the inner surface of the panel between the first fold line and the lower edge, the pocket open toward the first fold line; and an envelope formed on the outer surface of the panel having a bottom edge proximate the upper edge of the panel and an open edge spaced from the bottom edge relatively toward the first fold line, the envelope for mountingly receiving the edge of the supporting structure.

26. The trap bag of claim 25 further comprising:

a second fold line spaced between and parallel to the first and the second side edges.

27. A method of forming a trap bag mountable on a music desk having a shelf, the method comprising the steps of:

providing a panel of material having an upper edge and a lower edge opposed to the upper edge;

defining a first fold line between the upper edge and the lower edge of the panel;

forming at least one pocket on a first surface of the panel, the pocket between the lower edge and the first fold line of the panel and having an opening facing the first fold line;

forming a sleeve on a second surface of the panel along the upper edge of the panel, the sleeve having a lateral mounting slot therein.

28. The method of claim 27 further comprising the steps of:

forming a side wall along the first side of the panel between the upper edge thereof and the first fold line; and forming a side wall along the second side of the panel between the upper edge thereof and the first fold line.

* * * * *